US011225764B2

(12) United States Patent
Wyatt

(10) Patent No.: US 11,225,764 B2
(45) Date of Patent: Jan. 18, 2022

(54) COMBINATION SNOW SHOVEL AND ROOF RAKE

(71) Applicant: Joseph Wyatt, Moultonborough, NH (US)

(72) Inventor: Joseph Wyatt, Moultonborough, NH (US)

( * ) Notice: Subject to any disclaimer, the term of this patent is extended or adjusted under 35 U.S.C. 154(b) by 159 days.

(21) Appl. No.: 16/247,340

(22) Filed: Jan. 14, 2019

(65) Prior Publication Data

US 2020/0224380 A1 Jul. 16, 2020

(51) Int. Cl.

*E01H 5/02* (2006.01)
*E04D 13/10* (2006.01)
*E01H 5/06* (2006.01)

(52) U.S. Cl.

CPC ..... *E01H 5/02* (2013.01); *E01H 5/061* (2013.01); *E04D 13/106* (2013.01)

(58) Field of Classification Search

CPC ..... E01D 413/106; E01H 5/02; E01H 5/061; E01H 5/066; A01B 1/20; E04D 13/106; E04D 13/10

See application file for complete search history.

(56) References Cited

U.S. PATENT DOCUMENTS 2,785,483 A * 3/1957 Gajewski ..... A01B 1/20 37/284
2,867,827 A * 1/1959 Gantz ..... E01H 1/12 15/111
4,538,847 A * 9/1985 Lapshansky ..... A01B 1/222 294/51
4,597,204 A * 7/1986 Heiden ..... E01H 5/02 15/144.1
D298,906 S * 12/1988 Bonnes ..... D8/10
5,715,613 A * 2/1998 Ebert ..... E01H 5/066 37/221
D405,573 S * 2/1999 Tisbo ..... D32/49
D409,885 S * 5/1999 McKenzie ..... D8/10
D415,663 S * 10/1999 Whitehead ..... D8/10
5,983,504 A * 11/1999 Tisbo ..... E01H 5/02 294/54.5
RE36,588 E * 2/2000 Tisbo ..... E01H 5/02 294/54.5
6,018,894 A * 2/2000 Whitehead ..... E04D 13/106 294/54.5
6,338,210 B1 * 1/2002 Mele ..... E04D 13/0765 294/54.5
6,578,890 B1 * 6/2003 Gilmore ..... E04D 13/106 294/53.5
6,618,965 B1 * 9/2003 Schultz ..... E01H 5/061 37/232
7,216,907 B1 * 5/2007 Mussman ..... E01H 5/02 294/49
7,347,468 B1 * 3/2008 Tidcomb ..... A01B 1/022 15/117
D617,158 S * 6/2010 Smith ..... D8/10
(Continued)

*Primary Examiner* — Thomas B Will
*Assistant Examiner* — Joan D Misa
(74) *Attorney, Agent, or Firm* — Catherine Napjus; Michael Persson; Chisholm, Persson & Ball, PC

(57) ABSTRACT

A snow moving tool that has a handle and a curved lower shovel portion permanently affixed to an upper shovel portion so that as snow is scooped by the lower shovel portion, it is also pushed down by the upper shovel portion so that deep snow does not simply move over the top of the lower shovel portion.

8 Claims, 3 Drawing Sheets

(56) References Cited

U.S. PATENT DOCUMENTS

| | | | | |
|---|---|---|---|---|
| 8,136,269 | B1 * | 3/2012 | Sempf | E01H 5/068 37/266 |
| 8,347,528 | B1 * | 1/2013 | Seltzer | E01H 5/02 37/265 |
| 9,120,217 | B2 * | 9/2015 | Fischer, Jr. | B25G 1/04 |
| 9,408,459 | B2 * | 8/2016 | Cooke | A46B 15/0055 |
| 9,587,359 | B1 * | 3/2017 | Yu | E01H 5/02 |
| 9,670,632 | B2 * | 6/2017 | Behan | E01H 5/02 |
| 9,828,775 | B2 * | 11/2017 | Senchuk | E04D 13/106 |
| 9,885,183 | B1 * | 2/2018 | Miner | E04D 13/103 |
| 2016/0215465 | A1 * | 7/2016 | Reid | A46B 15/0055 |

* cited by examiner

COMBINATION SNOW SHOVEL AND ROOF RAKE

FIELD OF THE INVENTION

The present invention relates generally to snow removal, and specifically, to an improved snow shovel and roof rake.

BACKGROUND

Long, cold winters require frequent and repeated snow removal. In particular, it is advantageous to remove snow from one's roof. Snow remaining on roofs for an extended period of time may cause water damage, structural damage, ice dams in gutters, and generally reduce the lifetime of the roof. Despite this necessity, removing snow from roofs can be difficult and dangerous. Many devices have been invented that attempt to address this problem, but the problem remains.

SUMMARY OF THE INVENTION

The present invention is a combination snow shovel and roof rake. Although the present invention does encompass both functions implied in that title, hereinafter, the present invention will be referred to as a "snow shovel" alone.

In its most basic form, the snow shovel of the present invention includes a lower shovel portion, an upper shovel portion, where the lower and upper shovel portions are securely connected together, and a handle. The lower shovel portion includes a snow edge, a connection edge parallel to the snow edge, a curved body extending between the snow edge and the connection edge, and curved right and left sides on either side of the curved body, also extending between the snow edge and the connection edge. The curved body has a concave face and a convex face. The upper shovel portion includes a substantially rectangular base, surrounded by a rear edge, a scoop edge, and two sides. The rectangular base has a front, a back, two long sides, and two short sides. The rear edge and the scoop edge extend from the base's long sides. The two sides extend from the base's short sides. Each of the rear edge and the scoop edge extend from the base at an obtuse angle. The sides extend from the base at at least a 90° angle. By "substantially rectangular," it is meant that the base has a basically rectangular shape, but the edges may be rounded where they meet the rear edge, scoop edge, and sides, and the base may include protrusions, as discussed below, so that the base is not flat.

The positioning of the upper shovel portion above and behind the lower shovel portion is a key feature of the present invention. When shoveling snow with a prior art snow shovel that includes only a shovel head similar to the lower shovel portion, in deep snow, often a portion of the snow will simply be moved up and over the shovel head, only to resettle. This is snow that then needs to be again moved by the user. With the addition of the upper shovel portion, even deep snow cannot move up and over the lower shovel portion, but is caught by the upper shovel portion. This snow may all be moved in one stroke, therefore, rather than having to move snow that went up and over the lower shovel portion again.

The upper and lower shovel portions are preferably molded together as a single integrated piece. Struts are preferably included between the upper and lower shovel portions to support their connection during the stress induced during use of the snow shovel. The lower and upper shovel portions may also be securely connected with screws or bolts extending between the lower and upper shovel portions proximate to the connection edge of the lower shovel portion and the back of the base of the upper shovel portion.

It is preferred that the snow shovel also include two support beams extending between and securely attached on one end to the front of the base of the upper shovel portion and on one end to the handle.

It is preferred that one or both of the upper and/or lower shovel portions include protrusions. On the lower shovel portion, the protrusions protrude up and out of the curved body. On the upper shovel portion, the protrusions protrude up and out of the base.

It is preferred that the obtuse angle where the rear edge of the upper shovel extends from the base be less than the obtuse angle where the scoop edge of the upper shovel extends from the base.

It is preferred that the handle of the snow shovel extend from the convex face of the curved body of the lower shovel portion, but it is understood that the handle may extend from other portions of the snow shovel, such as from the upper shovel portion.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 1:
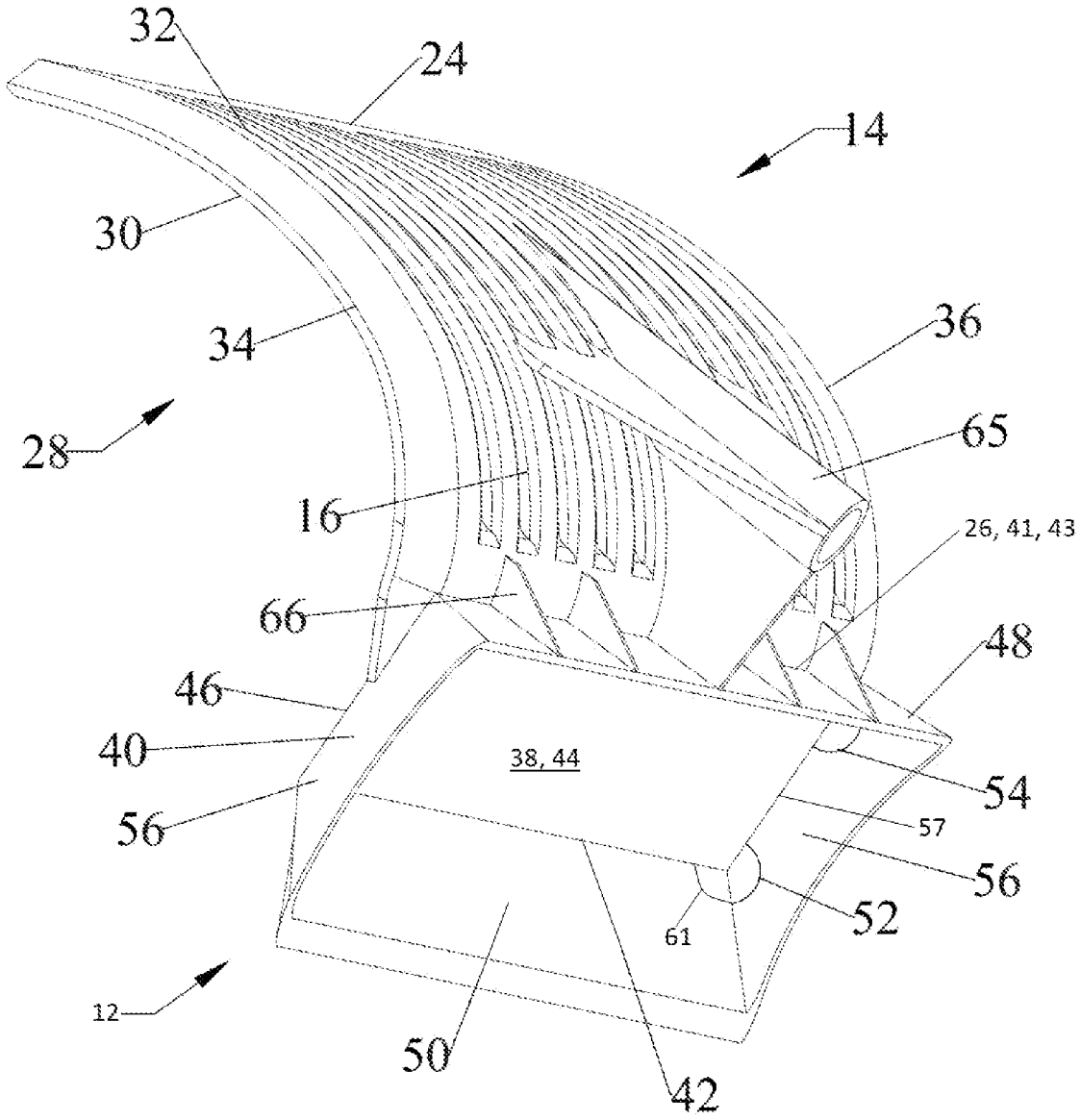
FIG. 1 is a perspective view of the snow shovel of the present invention.

Referring first to FIG. 1, a perspective view of snow shovel 10 of the present invention is provided. Snow shovel 10 includes lower shovel portion 14, upper shovel portion 12, and a handle, which is not shown but understood to extend from handle connection 65. Lower shovel portion 14 is a standard curved snow shovel head. Upper shovel portion 12 is a smaller, scoop-like shovel head permanently affixed to lower shovel portion 14. Upper shovel portion 12 and lower shovel portion 14 of snow shovel 10 are preferably integrated by being molded as one piece. Struts 66 support the connection of upper and lower shovel portions 12, 14, when stress is put on the snow shovel 10 during use.

Lower shovel portion 14 includes snow edge 24, connection edge 26 (shown more clearly in FIG. 2B), curved body 28, right side 34, and left side 36. Curved body 28 includes convex face 32, and concave face 30, understood to be the other face of the curved body 28, and not visible in this view. Upper shovel portion 12 includes substantially rectangular base 38, which is bound by near long side 41, far long side, 42, right short side 57, and left short side 59, rear edge 48, scoop edge 50, and two sides 56, forming a bowl shape or concave structure. Upper shovel portion 12 has essentially the shape of a regular or slightly irregular trapezoidal prism with the top cut off. Connection edge 26 of lower shovel portion 14 and near long side 41 of base 38 of upper shovel portion 12 intersect at inflection point 43, where curved body 28 of upper shovel portion 14 meets flat base 38 of upper shovel portion 12. The transition from curved to flat is shown clearly in FIG. 3. Upper and lower shovel portions 12, 14 are preferably made of durable plastic or metal. The handle is preferably made of wood, aluminum, or some combination thereof. Each of lower and upper shovel portions 14, 12 may include protrusions 16, which protrude out of the shovel head away from the viewer in this view. Upper shovel portion 12 may be braced by support beams extending between the base 38 and the handle (not shown).

Figure 2A:
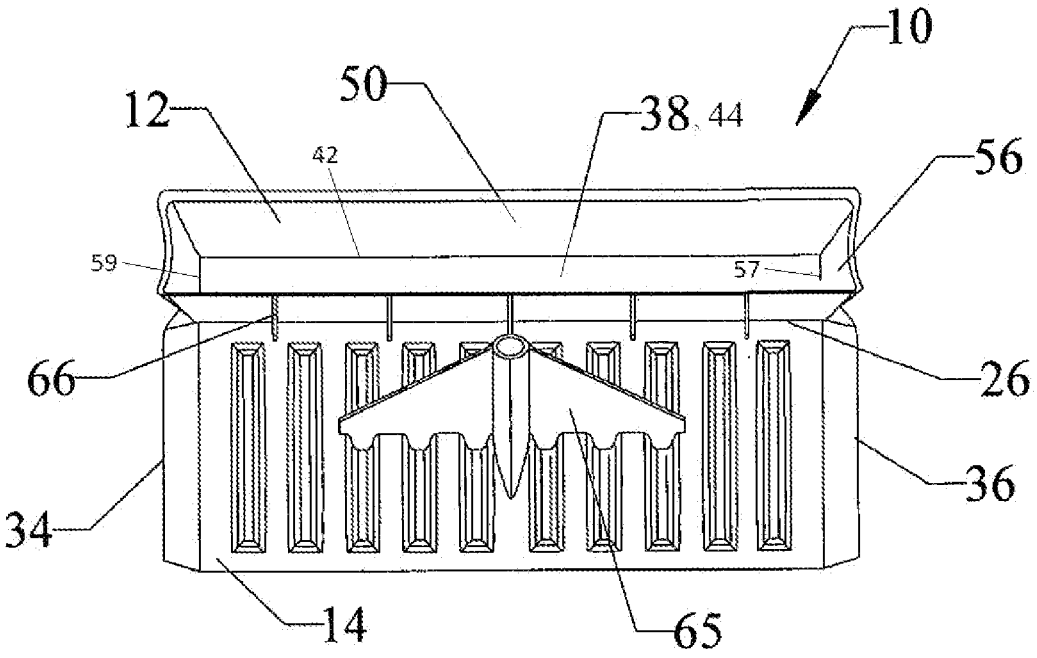
FIG. 2A is a back view of the snow shovel of the present invention.
Figure 2B:
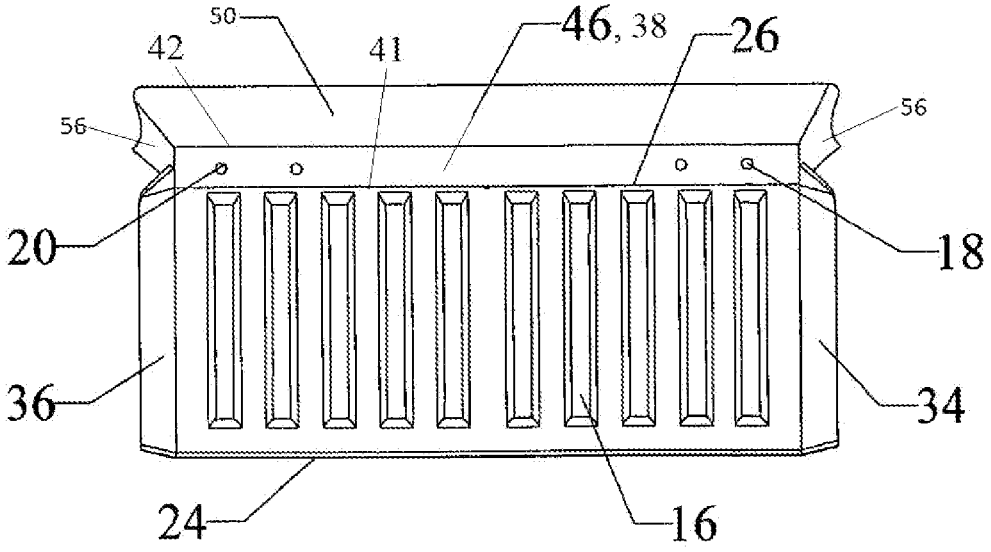
FIG. 2B is a front view of the snow shovel of the present invention.

Now referring to FIGS. 2A and 2B, back and front perspective views, respectively, of snow shovel 10 of the present invention are provided. In FIG. 2A, the scooping nature of upper shovel portion 12 is clear. The back of lower shovel portion 14 is shown with handle connection 65 extending out therefrom. Struts 66 support the connection of upper and lower shovel portions 12, 14. In FIG. 2B, screws 18 are shown as way of connecting upper and lower shovel portions 12, 14 when they are not molded as a single integrated piece.

Figure 3:
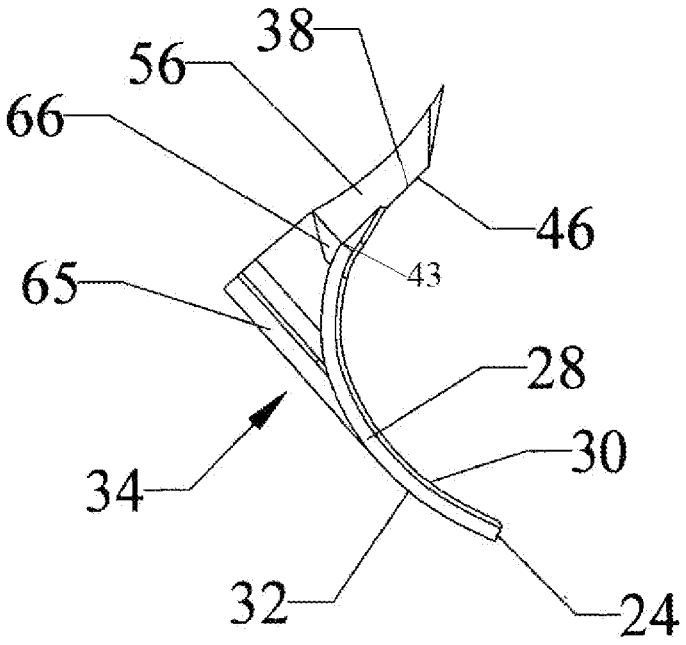
FIG. 3 is a side view of the snow shovel of the present invention.

Now referring to FIG. 3, a side view of snow shovel 10 of the present invention is provided. The curvature of curved body 28 of lower shovel portion 14 is apparent in this view. Concave face 30, convex face 32, snow edge 24, connection edge 26, and right side 34 are visible. The preferred lower shovel-handle connection 66 is also visible. The irregular trapezoidal shape of upper shovel portion 12 is visible in side 56. Each side 56 connects base 38 with rear and scoop edges 48, 50 of upper shovel portion 12.

Figure 4:
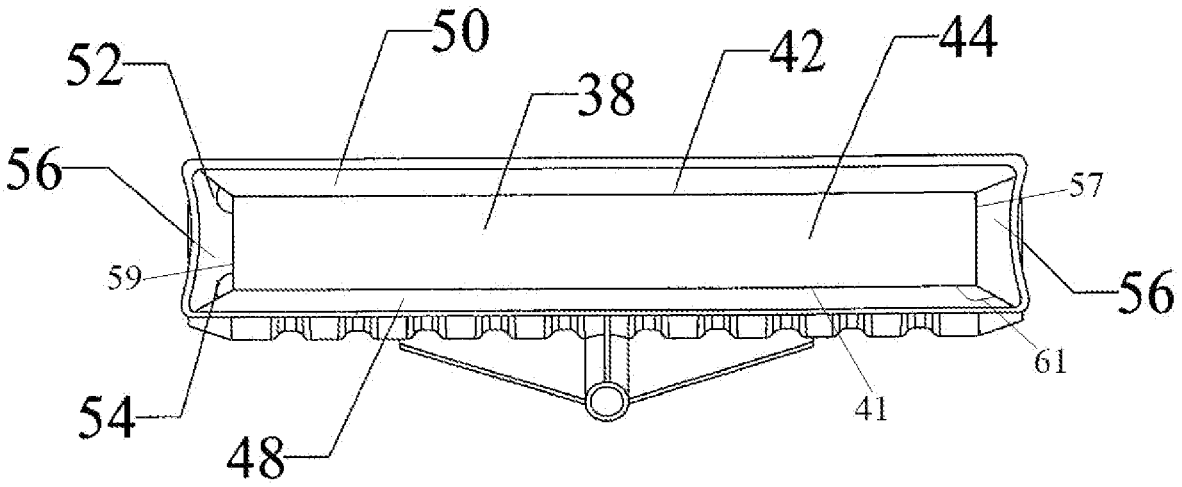
FIG. 4 is a perspective view of the upper shovel portion of the present invention.

Now referring to FIG. 4, a top down perspective view of upper shovel portion 12 is provided. Base 38 is bound by right short side 57, left short side 59, near long side 41, and far long side 42. Near long side 41 intersects with connection edge 26 and creates inflection point 43 (shown more clearly in FIGS. 1 and 3). Rear edge 48 extends up from near long side 41 of front 44 of base 38 at obtuse angle 54. Scoop edge 50 extends up from far long side 42 of front 44 of base 38 at obtuse angle 52. Short sides 56 extend up from right and left short sides 57, 59 of front 44 of base 38 at obtuse angle 61. Although obtuse angles 52, 54 may be equal so that upper shovel portion 12 has a regular trapezoidal prismatic shape, angle 52 between scoop edge 50 and base 38 may be greater than angle 54 between rear edge 48 and base 38. Base 38 has front 44, which faces away from lower shovel portion 14, and back 46, which is connected to connection edge 26 of lower shovel portion 12 and is shown most clearly in FIG. 2B.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

What is claimed is:

1. A snow shovel comprising:

a lower shovel portion comprising:

a snow edge;

a connection edge parallel to said snow edge;

a curved body extending between said snow edge and said connection edge, wherein said curved body comprises a concave face and a convex face; and curved right and left sides on either side of said curved body and also extending between said snow edge and said connection edge;

an upper shovel portion comprising:

a substantially rectangular base comprising right and left short sides, near and far long sides, a front, and a back, wherein:

said base is securely connected to said connection edge of said lower shovel portion at said near long side;

said back of said base is attached at an angle to and extends away from said concave face of said curved body of said lower shovel portion; and said front of said base is attached at an angle to and extends from said convex face of said curved body of said lower shovel portion;

a rear edge extending at an obtuse angle from said near long side of said front of said base, such that said rear edge is disposed between said front of said base and said convex face of said lower shovel portion;

a scoop edge extending at an obtuse angle from said far long side of said front of said base; and two sides extending at an obtuse angle from each of said right and left short sides of said front of said base and connecting said rear edge and said scoop edge, such that said front of said base, said rear edge, said scoop edge, and said two sides form a bowl shape; and a handle connected to said convex face of said curved body of said lower shovel portion.

2. The snow shovel as claimed in claim 1, wherein said curved body of said lower shovel portion comprises protrusions protruding out of said curved body.

3. The snow shovel as claimed in claim 1, wherein said obtuse angle at which said rear edge of said upper shovel portion extends from one of said long sides of said base is less than said obtuse angle at which said scoop edge of said upper shovel portion extends from the other of said long sides of said base.

4. The snow shovel as claimed in claim 1, wherein said lower and upper shovel portions are connected by being molded as a single integrated piece.

5. The snow shovel as claimed in claim 1, wherein said connection edge of said lower shovel portion and said base of said upper shovel portion are securely connected by at least two screws extending between said connection edge of said lower shovel portion and said base of said upper shovel portion.

6. The snow shovel as claimed in claim 1, wherein said handle extends from said convex face of said curved body of said lower shovel portion.

7. The snow shovel as claimed in claim 1, further comprising a plurality of struts disposed between said upper and lower shovel portions.

8. The snow shovel as claimed in claim 1, wherein the connection between said connection edge of said lower shovel portion and said near long side of said base of said upper shovel portion creates an inflection point.

* * * * *